US007610197B2

(12) United States Patent
Cruz-Zeno et al.

(10) Patent No.: US 7,610,197 B2
(45) Date of Patent: Oct. 27, 2009

(54) METHOD AND APPARATUS FOR COMFORT NOISE GENERATION IN SPEECH COMMUNICATION SYSTEMS

(75) Inventors: Edgardo M. Cruz-Zeno, Round Lake, IL (US); James P. Ashley, Naperville, IL (US)

(73) Assignee: Motorola, Inc., Schaumburg, IL (US)

( * ) Notice: Subject to any disclaimer, the term of this patent is extended or adjusted under 35 U.S.C. 154(b) by 628 days.

(21) Appl. No.: 11/216,624

(22) Filed: Aug. 31, 2005

(65) Prior Publication Data

US 2007/0050189 A1 Mar. 1, 2007

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS

| | | | | |
|---|---|---|---|---|
| 5,657,422 | A * | 8/1997 | Janiszewski et al. | 704/229 |
| 5,870,397 | A | 2/1999 | Chauffour et al. | |
| 5,949,888 | A * | 9/1999 | Gupta et al. | 381/66 |
| 6,081,732 | A * | 6/2000 | Suvanen et al. | 455/570 |
| 6,522,746 | B1 * | 2/2003 | Marchok et al. | 379/406.03 |
| 6,526,139 | B1 * | 2/2003 | Rousell et al. | 379/406.03 |
| 6,526,140 | B1 * | 2/2003 | Marchok et al. | 379/406.03 |
| 6,577,862 | B1 | 6/2003 | Davidson et al. | |
| 6,606,593 | B1 | 8/2003 | Jarvinen et al. | |
| 6,738,358 | B2 * | 5/2004 | Bist et al. | 370/289 |
| 7,031,269 | B2 * | 4/2006 | Lee | 370/290 |
| 7,039,181 | B2 * | 5/2006 | Marchok et al. | 379/406.03 |
| 7,124,079 | B1 * | 10/2006 | Johansson et al. | 704/226 |
| 7,243,065 | B2 * | 7/2007 | Stephens et al. | 704/226 |
| 7,318,030 | B2 * | 1/2008 | Guduru | 704/243 |
| 7,454,010 | B1 * | 11/2008 | Ebenezer | 379/392.01 |
| 7,464,029 | B2 * | 12/2008 | Visser et al. | 704/210 |
| 2005/0278171 | A1 | 12/2005 | Suppappola et al. | |

FOREIGN PATENT DOCUMENTS

| | | | |
|---|---|---|---|
| GB | 2356538 | A | 5/2001 |
| GB | 2358558 | A | 7/2001 |
| WO | 02101722 | A1 | 12/2002 |

OTHER PUBLICATIONS

Doblinger, G. Ed - European Speech Communication Association (ESCA): "Computationally Efficient Speech Enhancement by Spectral Minima Tracking in Subbands", 4th European Conference on Speech Communication and Technology, Europspeech '95, Madrid, Spain, Sep. 18-21, 1995, European Conference on Speech Communication and Technology, (Eurospeech), Madrid: Graficas Brens, ES, vol. vol. 2 Conf. 4, Sep. 18, 1995, pp. 1513-1516.

Lee, I D et al.: "A voice activity detection algorithm for communication systems with dynamically varying background acoustic noise", Vehicular Technology Conference, 1998, VTC 98, 48th IEEE Ottawa, Ont. Canada May 18-21, 1998, New York, NY, USA, IEEE, US vol. 2, May 18, 1998, pp. 1214-1218.

* cited by examiner

*Primary Examiner*—Susan McFadden

(57) ABSTRACT

A method that may be used in variety of electronic devices for generating comfort noise includes receiving a plurality of information frames indicative of speech plus background noise, estimating one or more background noise characteristics based on the plurality of information frames, and generating a comfort noise signal based on the one or more background noise characteristics. The method may further include generating a speech signal from the plurality of information frames, and generating an output signal by switching between the comfort noise signal and the speech signal based on a voice activity detection.

12 Claims, 6 Drawing Sheets

METHOD AND APPARATUS FOR COMFORT NOISE GENERATION IN SPEECH COMMUNICATION SYSTEMS

FIELD OF THE INVENTION

This invention relates, in general, to communication systems, and more particularly, to comfort noise generation in speech communication systems.

BACKGROUND OF THE INVENTION

To meet the increasing demand for mobile communication services, many modern mobile communication systems increase their capacity by exploiting the fact that during conversation the channel is carrying voice information only 40% to 60% of the time. The rest of the time the channel is only utilized to transmit silence or background noise. In many cases the voice activity in the channel is even lower than 40%. Conventional mobile communication systems, such as discontinuous transmission (DTX), have provided some increase in channel capacity by sending a reduced amount of information during the time there is no voice activity.

Referring to FIG. 1, a timing diagram shows a typical analog speech signal 105 and a corresponding data frame signal 110 for a conventional DTX system. In DTX systems, a transmitting end typically detects the presence of voice using voice activity detectors (VAD). Based on the VAD output, the transmitting end sends active voice frames 115 when there is voice activity. When no voice activity is detected, the transmitting end intermittently sends Silence Identification [Silence Descriptor] (SID) frames 120 to the receiving end and stops transmitting active voice frames until voice is again detected or an update SID is required. The decoding (Receiving) end uses the SID frames 120 to generate "comfort" noise. While no SID frames are received, the decoder continues to generate comfort noise based on the last SID frames it had received. An example of a conventional DTX system is described in 3*GPP TS* 26.092 *V*6.0.0 (2004-12) *Technical Specification* issued by 3rd Generation Partnership Project; Technical Specification Group Services and System Aspects; Mandatory speech codec speech processing functions, Adaptive Multi-Rate (AMR) speech codec Comfort noise aspects(Release 6).

Referring to FIG. 2, a timing diagram shows a typical analog speech signal 205 and a corresponding data frame signal 210 for a conventional CTX system. In CTX systems a variable rate vocoder may be employed to exploit the voice activity in the channel. In these systems the bit rate required for maintaining the communication link is reduced during periods of no voice activity. The VAD is part of a rate determination sub-system that varies the transmitted bit rate according to the voice activity and type of speech frame being transmitted. An example of such a technique is the enhanced variable rate codec (EVRC) used in CDMA systems. The EVRC selects between three possible bit-rates (full, half, and eight rate frames). During no speech activity only eighth rate frames are transmitted, thus reducing the bandwidth utilized by the channel in the system. This technique helps increase the capacity of the overall system. An example of a conventional CTX system is described in 3*GPP*2 *C.S*0014-*A V*1.0 April 2004, issued by Enhnaced Variable Rate Codec, Speech Service Option 3 for Wideband Spread Spectrum Digital Systems.

In packet-based communication systems, bandwidth reduction schemes such as those used in DTX or CTX systems with variable-rate codecs may not provide a significant capacity increase. In DTX networks a SID frame, for example, may use up bandwidth that is equivalent to that of a normal speech frame. For CTX systems, the advantage of using variable-rate codecs may not provide a significant bandwidth reduction on packed-based networks. This is due to the fact that the reduced bit-rate frames may utilize similar bandwidth in the packet-based network as a voice-active frame. For example, when an EVRC is used, an eighth rate packet may utilize similar bandwidth as a full rate or half rate packet due to overhead information added to each packet, thus eliminating the capacity increase provided by the variable-rate codec that is obtained on other types of communication channels.

One approach to reducing bandwidth utilization in packet-based networks using the EVRC is to eliminate the transmission of all eighth rate packets. Then, on the decoding side, the missing packets may be treated as frame erasures (FER). However, the FER handling of the EVRC was not designed to handle a long string of erased frames, and thus this technique produces poor quality output when synthesizing the signal presented to the user. Also, since the decoder does not receive any information on the background noise represented by the dropped eighth rate frames, it cannot generate a signal that resembles the original background noise signal at the transmit side.

Thus there is a need to improve the above method to achieve higher quality while reducing network bandwidth utilization.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate the embodiments and explain various principles and advantages, in accordance with the present invention.

Figure 1:
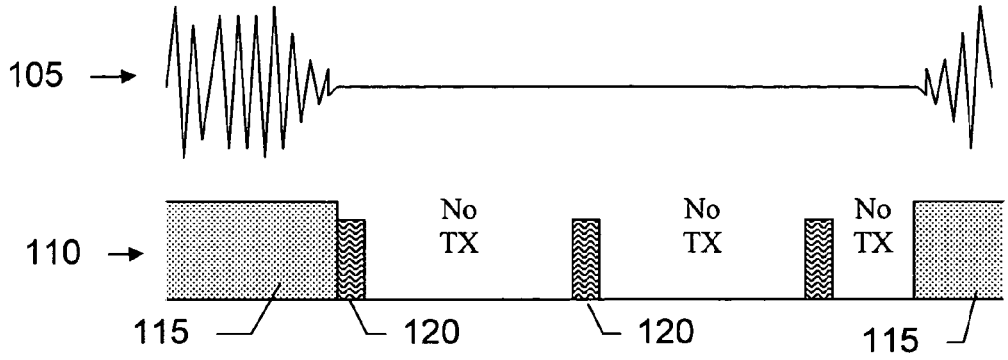
Prior Art FIG. 1
FIG. 1 is a timing diagram that shows a typical analog speech signal and a corresponding data frame signal for a conventional discontinuous transmission system.
Figure 2:
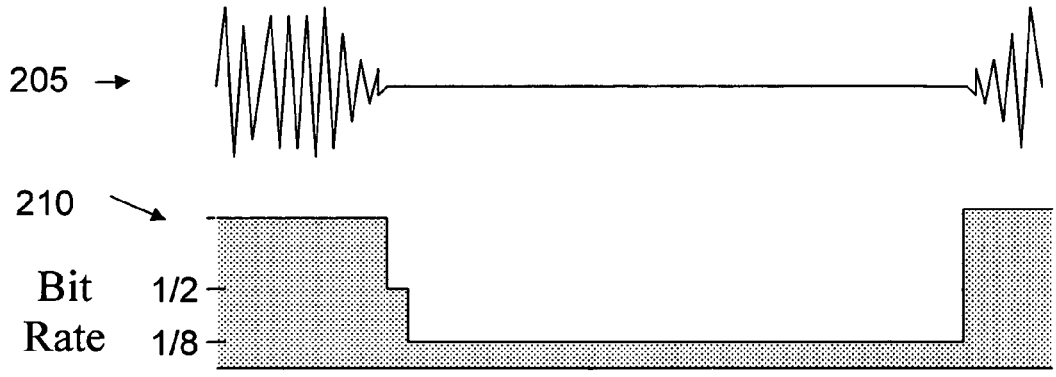
Prior Art FIG. 2
FIG. 2 is a timing diagram that shows a typical analog speech signal and a corresponding data frame signal for a conventional continual transmission system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to generating comfort noise in a speech communication system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

In the following, a frame suppression method is described that reduces or eliminates the need to transmit non-voice frames in CTX systems. In contrast to prior art methods, the method described here provides better synthesis of comfort noise and reduced bandwidth utilization especially on packed-based networks.

Figure 3:
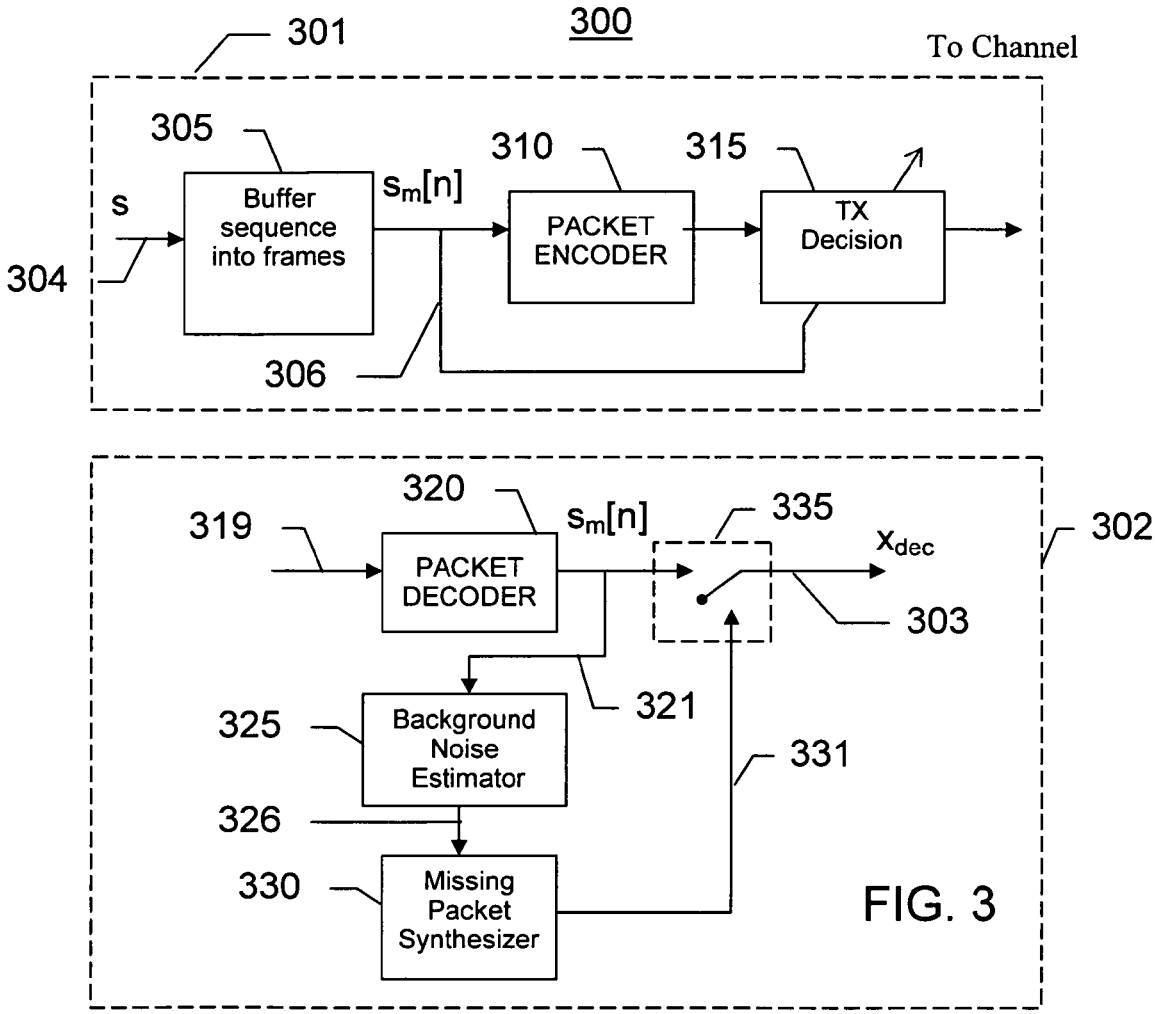
FIG. 3 is a functional block diagram of an encoder-decoder, in accordance with some embodiments of the present invention

Referring to FIG. 3, a functional block diagram of an encoder-decoder 300 is shown, in accordance with some embodiments of the present invention. The encoder-decoder 300 comprises an encoder 301 and a decoder 302. An analog speech signal 304, s, is broken into frames 306 by a frame buffer 305 and encoded by packet encoder 310. Based on properties of the input signal, a decision is made by a DTX switch 315 to transmit or omit the current speech packet. On the decoding side, received packets 319, are decoded by packet decoder 320 into frames $s_m(n)$, which are also called information frames 321.

The embodiments of the present invention described herein do not require the packet encoder 310 (transmit side) to send any SID frames, as is done in U.S. Pat. No. 5,870,397, or noise encoding (eighth rate) frames, although they can be used if they are received at the packet decoder 320. In order to reproduce comfort noise, a background noise estimator 325 may be used in these embodiments to process decoded active voice information frames 321 and generate an estimated value of the spectral characteristics 326 (also called the background noise characteristics) of the background noise. These estimated background characteristics 326, are used by a missing packet synthesizer 330 to generate a comfort noise signal 331. A switch 335 is then used to select between the information frames 321 and the comfort noise 331, to generate an output signal 303. The switch is activated by a voice activity detector (not shown in FIG. 3) that detects when information frames containing active voice are not received for a predetermined time, such as a time period of 2 normal frames.

As described in more detail below, the switch 335 may be considered to be a "soft" switch.

Figure 4:
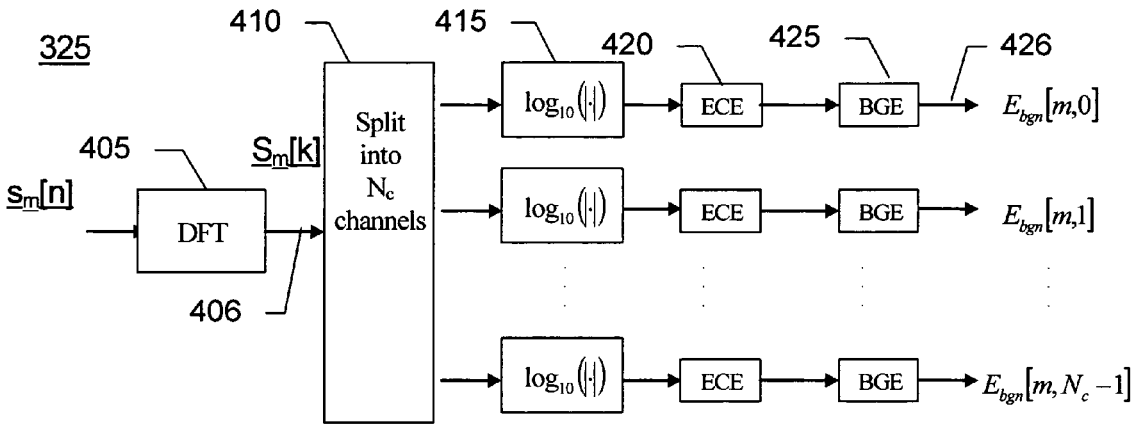
FIG. 4 is a functional block diagram of a background noise estimator, in accordance with embodiments of the present invention.

Referring to FIG. 4, a functional block diagram of the background noise estimator is shown, in accordance with embodiments of the present invention. For a decoded speech plus noise frame m, also called herein a information frame, the background noise estimate may be obtained from the speech plus noise signal 321, $s_m(n)$, as follows. First, a Discrete Fourier Transform (DFT) function 405 is used to obtain a DFT of a speech plus noise frame 406, $S_m(k)$, wherein k is an index for the bins. For each bin k of the spectral representation of the frame, or for each of a group of bins called a channel, an estimated channel or bin energy, $E_{ch}(m,i)$, is computed. This may be accomplished by using equation 1 below for each channel i, from i=0 to $N_c-1$, wherein $N_c$ is the number of channels. For each value of i, this operation may be performed by one of the estimated channel energy estimators (ECE) 420 as illustrated in FIG. 4.

$$E_{ch}(m, i) = \max\left\{\begin{array}{c} E_{\min},\ \alpha_w(m)E_{ch}(m-1, i) + \\ (1-\alpha_w(m))\cdot 10\log_{10}\left(\sum_{k=f_L(i)}^{f_H(i)} |S_m(k)|^2\right) \end{array}\right\} \quad (1)$$

wherein $E_{min}$ is a minimum allowable channel energy, $\alpha_w(m)$ is a channel energy smoothing factor (defined below), and $f_L(i)$ and $f_H(i)$ are i-th elements of respective low and high channel combining tables, which may be the same limits defined for noise suppression for an EVRC as shown below, or other limits determined to be appropriate in another system.

$$f_L=\{2, 4, 6, 8, 10, 12, 14, 17, 20, 23, 27, 31, 36, 42, 49, 56\},$$

$$f_H=\{3, 5, 7, 9, 11, 13, 16, 19, 22, 26, 30, 35, 41, 48, 55, 63\}. \quad (2)$$

The channel energy smoothing factor, $\alpha_w(m)$, can be varied according to different factors, including the presence of frame errors. For example, the factor can be defined as:

$$\alpha_w(m) = \begin{cases} 0; & m \le 1 \\ 0.85w_\alpha; & m > 1 \end{cases} \quad (3)$$

This means that $\alpha_w(m)$ assumes a value of zero for the first frame (m=1) and a value of 0.85 times the weight coefficient $w_\alpha$ for all subsequent frames. This allows the estimated channel energy to be initialized to the unfiltered channel energy of the first frame, and provides some control over the adaptation via the weight coefficient for all other frames. The weight coefficient can be varied according to:

$$w_\alpha = \begin{cases} 1.0; & \text{frame_error} = 1 \\ 1.1; & \text{otherwise} \end{cases} \quad (4)$$

An estimate of the background noise energy for each channel, $E_{bgn}(m,i)$, may be obtained and updated according to:

$$E_{bgn}(m, i) = \begin{cases} E_{ch}(m, i); & E_{ch}(m, i) < E_{bgn}(m-1, i) \\ E_{bgn}(m-1, i) + 0.005; & (E_{bgn}(m, i) - E_{bgn}(m-1, i)) > 12 \text{ dB} \\ E_{bgn}(m-1, i) + 0.01; & \text{otherwise} \end{cases} \quad (5)$$

For each value of i, this operation may be performed by one of the background noise estimators 425 as illustrated in FIG. 4. The background noise estimate $E_{bgn}$ given by equation (5) is one form of background characteristics that may be used as further described below with reference to FIGS. 5 and 6. Others may also be used.

It will be appreciated that when the estimated channel energy for a channel i of frame m is less than the background noise energy estimate of channel i in frame m−1, the background noise energy estimate of channel i of frame m is set to the estimated channel energy for a channel i of frame m.

When the estimated channel energy for a channel i of frame m is greater than the background noise estimate of channel i in frame m−1 by a value that in this example is 12 decibels, the background noise estimate of channel i of frame m is set to the background noise for a channel i of frame m−1, plus a first small increment, which in this example is 0.005 decibels. The value 12 represents a minimum decibel value at which it is highly likely that the channel energy is active voice energy, also identified herein as $E_{voice}$. The first small increment is identified herein as $\Delta_1$. It will be appreciated that when the frame rate is 50 frames per second, and $E_{ch}$ remains above $E_{voice}$ in some frequency channels for several seconds, the background noise estimates are raised by 0.25 decibels per second.

When the estimated channel energy for a channel i of frame m is greater than the background noise estimate of channel i in frame m−1 by a value that in this example is less than 12 decibels and is also greater than or equal to the background noise estimate of channel i in frame m−1, the background noise energy estimate of channel i of frame m is set to the background noise energy estimate for a channel i of frame m−1, plus a second small increment, which in this example is 0.01 decibels. The value 12 decibels represents $E_{voice}$. The second small increment is identified herein as $\Delta_2$. It will be appreciated that when the frame rate is 50 frames per second, and the estimated channel energy remains above $E_{voice}$ in some frequency channels for several seconds, the background noise energy estimates are raised by 0.5 decibels per second per channel. It will be appreciated that when the estimated channel energy is closer to the background noise energy estimate from the previous frame, the background noise energy estimate is incremented by a larger value, because it is more likely that the channel energy is from background noise. It will be appreciated that for this reason, $\Delta_2$ is larger than $\Delta_1$ in theses embodiments.

In some embodiments, the values of $E_{voice}$, $\Delta_1$, and $\Delta_2$ may be chosen differently, to accommodate differences in system characteristics. For example, $\Delta$ or $\Delta_1$ may be designed to be at most 0.5 dB; $\Delta_2$ may be designed to be at most 1.0 dB; and $E_{voice}$ may be less than 50 dB.

Also, more intervals could be used, such that there are a plurality of increments, or that the increment could be computed from a ratio of the difference of the estimate channel energy of channel i of frame m and the background noise estimate of channel i in frame m−1 to a reference value (e.g., 12 decibels). Other functions apparent to one of ordinary skill in the art could be used to generate background characteristics that make good estimates of background audio that exists simultaneously with voice audio.

In some embodiments, the background noise estimators may determine the background characteristics 426, $E_{bgn}(m, i)$, according to a simpler technique:

$$E_{bgn}(m, i) = \begin{cases} E_{ch}(m, i); & E_{ch}(m, i) < E_{bgn}(m-1, i) \\ E_{bgn}(m-1, i) + \Delta; & \text{otherwise} \end{cases} \quad (6)$$

The values of background noise energy estimates (background characteristics) provided by this technique may not work as well as those described above, but would still provide some of the benefits of the other embodiments described herein.

Figure 5:
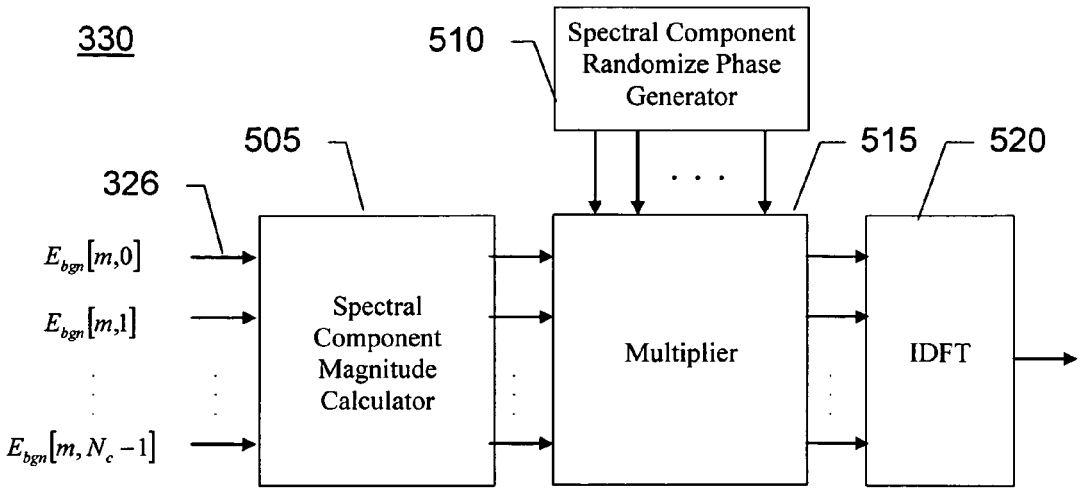
FIG. 5 is a functional block diagram of a missing packet synthesizer, in accordance with some embodiments of the present invention.

Referring to FIG. 5, a functional block diagram of the missing packet synthesizer 330 (FIG. 3) is shown, in accordance with some embodiments of the present invention. The background noise estimate $E_{bgn}$ 326 is updated for every received speech frame by the background noise estimator 325 (FIG. 3). When the packet decoder 320 receives a packet for frame m, it is decoded to produce $S_m$ (n). When the packet decoder 320 detects that a speech frame is missing or has not been received, the missing packet synthesizer 330 operates to synthesize comfort noise based on the spectral characteristics of $E_{bgn}$. The comfort noise may be synthesized as follows.

First, the magnitude of the spectrum of the comfort noise, $X_{decmag}(m,k)$, is generated by a spectral component magnitude calculator 505, based on the background noise estimates 426, $E_{bgn}$ (m,i). This may be accomplished as show in equation (7).

$$X_{decmag}(m,k)=10^{E_{bgn}(m,i)/20};\ f_L(i)\leqq k\leqq f_H(i),\ 0\leqq i<N_c \quad (7)$$

Random spectral component phases are generated by a spectral component random phase generator 510 according to:

$$\phi(k)=\cos(2\pi\cdot\text{ran }0\{\text{seed}\})+j\sin(2\pi\cdot\text{ran }0\{\text{seed}\}) \quad (8)$$

where ran0 is a uniformly distributed pseudo random number generator spanning [0.0, 1.0). The background noise spectrum is generated by a multiplier 515 as $$X_{dec}(m,k)=X_{decmag}(m,k)\cdot\phi(k) \quad (9)$$

and is then converted to the time domain using an inverse DFT 520, producing $$x_{dec}(m, n) = \begin{cases} x_{dec}(m-1, L-D+n) + g(n)\cdot\frac{1}{2}\sum_{k=0}^{M-1} X_{dec}(k)e^{j2\pi nk/M}; & 0 \le n < D. \\ g(n)\cdot\frac{1}{2}\sum_{k=0}^{M-1} X_{dec}(k)e^{j2\pi nk/M}; & D \le n < M. \end{cases} \quad (10)$$

where g(n) is a smoothed trapezoidal window defined by $$g(n)=\begin{cases}\sin^2(\pi(n+0.5)/2D); & 0\le n<D,\\ 1; & D\le n<L,\\ \sin^2(\pi(n-L+D+0.5)/2D); & L\le n<D+L,\\ 0; & D+L\le n<M\end{cases}\tag{11}$$

wherein L is a digitized audio frame length, D is a digitized audio frame overlap, and M is a DFT length.

For equation (10), $x_{dec}(m-1,n)$ is the previous frame's output, which can come from the packet decoder 320 or from a generated comfort noise frame when no active voice packet was received. Equation 10 defines how the speech signal $X_{dec}$ is generated during a period of comfort noise and for one active voice frame after the period of comfort noise, by using overlap-add of the previous and current frame to smooth the audio through the transition of frames. By these equations, the smoothing also occurs during the transitions between successive comfort noise frames, as well as the transitions between comfort noise and active voice, and vice versa. Other conventional overlap functions may be used in some other embodiments. The overlap that results from the use of equations 10 and 11 may be considered to invoke a "soft" form of a switch such as the switch 335 in FIG. 3.

Figure 6:
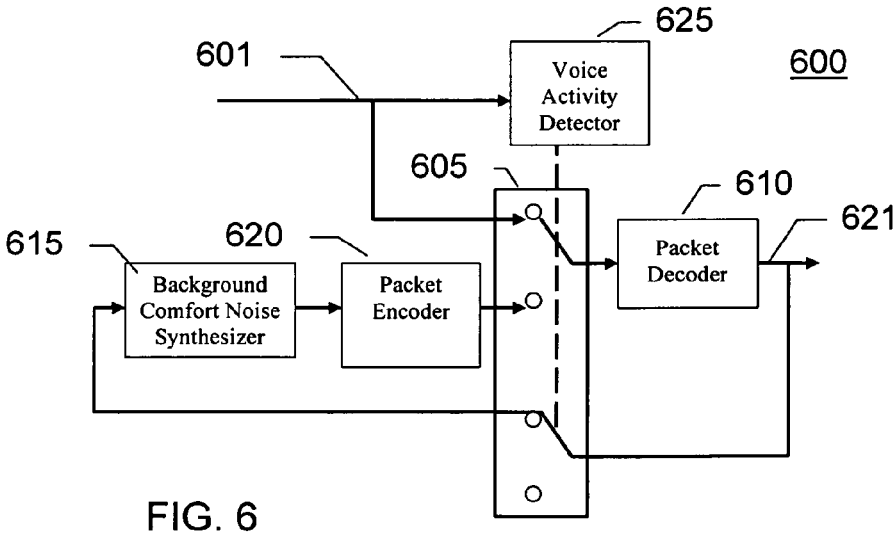
FIG. 6 is a functional block diagram of a re-encoder, in accordance with some embodiments of the present invention.

Referring to FIG. 6, a functional block diagram of a re-encoder 600 is shown, in accordance with some embodiments of the present invention. The technique described so far with reference to FIGS. 3-5 and equations 1-11 produces good results but better results may be provided in some systems by incorporating a re-encoding scheme. In the re-encoding scheme, packets received over a communication link 601 are coupled to a voice activity detector (VAD) 625 and passed through a switch 605 and decoded by a packet decoder 610 when voice activity is detected. The VAD 625 detects the presence or absence of packets that contain voice activity, and controls a switch 605 by the resulting determination. When voice activity is detected, the packet decoder 610 generates digitized audio samples of active voice, as a speech signal portion of an output signal 621. The audio samples of active voice are simultaneously feed back through switch 605 and the results are coupled to a background comfort noise synthesizer 615, which comprises the background noise estimator 325 and the missing packet synthesizer 330 as described herein above. The output of the background comfort noise synthesizer 615 is coupled to an encoder that generates packets representing the comfort noise generated by the background comfort noise synthesizer 615. The output of the encoder 620 is not used when active voice is being detected. When the VAD 625 determines that there are no voice activity packets, the output of the packet encoder 620 is then switched to the input of the packet decoder 610, producing digitized noise samples for a comfort noise signal portion of the output signal 621.

In some embodiments, the VAD 625 may be replaced by a valid packet detector that causes the switch 605 to be in a first state when valid packets, such as eighth rate packets that convey comfort noise and other packets that convey active voice, are received, and is in a second state when packets are determined to be missing. When the output of the valid packet detector is in the first state, the switch 605 couples the packets received over a communication link 601 to the packet decoder 610 and the output of the packet decoder 610 is coupled to the background noise synthesizer 615. When the output of the valid packet detector is in the second state, the switch 605 couples the output of the packet encoder 620 to the packet decoder 610 and the output of the packet decoder 610 is no longer coupled to the background noise synthesizer 615. Furthermore, the background comfort noise synthesizer 615 may be altered to incorporate an alternative background noise estimation method, for example, as given by $$E_{bgn}(m,i)=\beta E_{bgn}(m-1,i)+(1-\beta)E_{ch}(m,i)\tag{12}$$

wherein β is a weighting factor having a value in the range from 0 to 1. This equation is used to update the background noise estimate when non-voice frames are received. The update method of this equation may be more aggressive than that provided by equations 5 and 6, which are used when voice frames are received.

It will be appreciated that while the term "background noise" has been used throughout this description, the energy that is present whether or not voice is present may be something other than what is typically considered to be noise, such as music. Also, it will be appreciated that the term "speech" is construed to mean utterances or other audio that is intended to be conveyed to a listener, and could, for example, include music played close to a microphone, in the presence of background noise.

Figure 7:
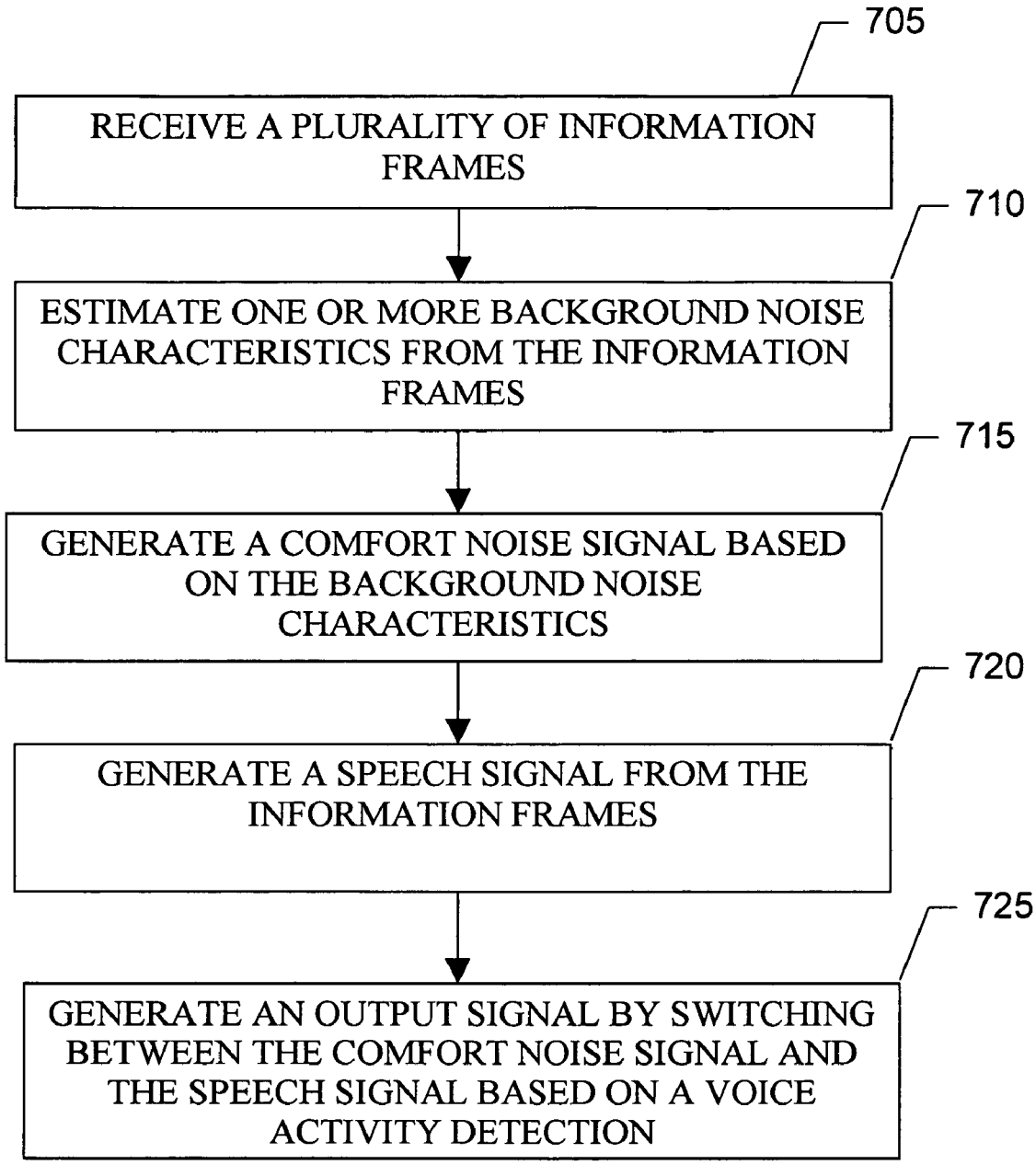
FIG. 7 is a flow chart that illustrates some steps of a method to generate comfort noise in speech communication, in accordance with embodiments of the present invention.

In summary, as illustrated by a flow chart in FIG. 7, some steps of a method to generate comfort noise in speech communication that are in accordance with embodiments of the present invention include receiving 705 a plurality of information frames indicative of speech plus background noise, estimating 710 one or more background noise characteristics based on the plurality of information frames, and generating a comfort noise signal 715 based on the one or more background noise characteristics. The method may further include generating a speech signal 720 from the plurality of information frames, and generating an output signal 725 by switching between the comfort noise signal and the speech signal based on a voice activity detection.

Figure 8:
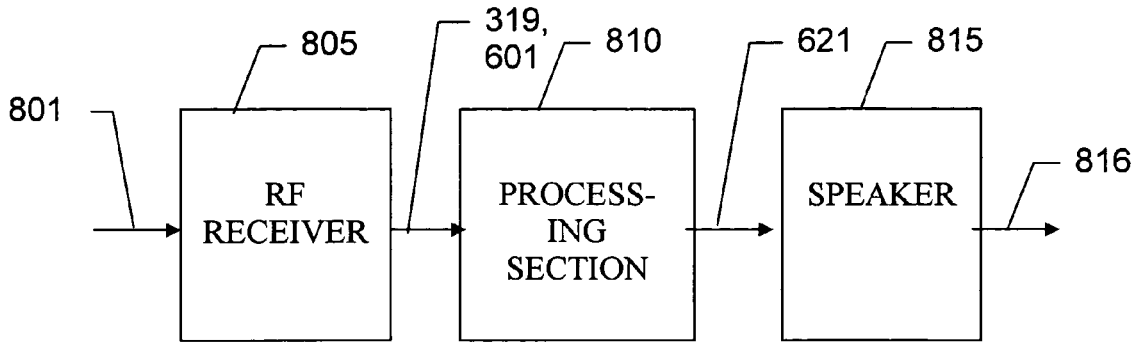
FIG. 8 shows a block diagram of an electronic device that is an apparatus capable of generating audible comfort noise, in accordance with some embodiments of the present invention.

Referring to FIG. 8, a block diagram shows an electronic device 800 that is an apparatus capable of generating audible comfort noise, in accordance with some embodiments of the present invention. The electronic device 800 comprises a radio frequency receiver 805 that receives a radio signal 801 and decodes information frames, such as the information frames 319, 601 (FIGS. 3, 6) described above, from the radio signal and couples them to a processing section 810. As in the situations described herein above, the information frames convey a speech signal that includes speech portions and background noise portions; the speech portions also include background noise, typically at energy levels lower than the speech audio included in the speech portions, and typically very similar to the background noise included in the background noise portions. The processing section 810 includes program instructions that control one or more processors to perform the functions described above with reference to FIG. 7, including the generation of an output signal 621 that includes comfort noise. The output signal 621 is coupled through appropriate electronics (not shown in FIG. 8) to a speaker 815 that presents an audible output 816 based on the output signal 621 of FIG. 6. The audible output usually includes both audible speech portions and audible comfort noise portions.

It will be appreciated that the embodiments described herein provide a method and apparatus that generates comfort noise at a device receiving a speech signal, such as a cellular telephone, without having to transmit any information about the background noise content of the speech signal during those times when only background noise is being captured by a device transmitting the speech signal the receiver. This is valuable inasmuch as it allows the saving of bandwidth relative to conventional methods and means for transmitting and receiving speech signals.

It will be appreciated that embodiments of the invention described herein may be comprised of one or more conventional processors and unique stored program instructions that control the one or more processors to implement, in conjunction with certain non-processor circuits, some, most, or all of the functions of the embodiments of the invention described herein. The non-processor circuits may include, but are not limited to, a radio receiver, a radio transmitter, signal drivers, clock circuits, power source circuits, and user input devices. As such, these functions may be interpreted as steps of a method to perform comfort noise generation in a speech communication system. Alternatively, some or all functions could be implemented by a state machine that has no stored program instructions, or in one or more application specific integrated circuits (ASICs), in which each function or some combinations of certain of the functions are implemented as custom logic. Of course, a combination of these approaches could be used. Thus, methods and means for these functions have been described herein. In those situations for which functions of the embodiments of the invention can be implemented using a processor and stored program instructions, it will be appreciated that one means for implementing such functions is the media that stores the stored program instructions, be it magnetic storage or a signal conveying a file. Further, it is expected that one of ordinary skill, notwithstanding possibly significant effort and many design choices motivated by, for example, available time, current technology, and economic considerations, when guided by the concepts and principles disclosed herein will be readily capable of generating such stored program instructions and ICs with minimal experimentation.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An apparatus for comfort noise generation in a speech communication system, comprising a decoder configured to receive a plurality of information frames indicative of speech plus background noise; estimate one or more background noise characteristics based on the plurality of information frames wherein $$E_{bgn}(m, i) = \begin{cases} E_{ch}(m, i); & E_{ch}(m, i) < E_{bgn}(m-1, i) \\ E_{bgn}(m-1, i) + \Delta_1; & (E_{ch}(m, i) - E_{bgn}(m-1, i)) > E_{voice} \\ E_{bgn}(m-1, i) + \Delta_2; & \text{otherwise} \end{cases}$$

and wherein:

$E_{bgn}$(m,i) is an estimated background noise energy value of an $i^{th}$ frequency channel of an $m^{th}$ frame of the plurality of information frames, $E_{ch}$(m,i) is a estimated channel energy value of the $i^{th}$ frequency channel of the $m^{th}$ frame of the plurality of information frames, $E_{bgn}$(m−1,i) is an estimated background noise energy value of the $i^{th}$ frequency channel of the $(m-1)^{th}$ frame of the plurality of frequency frames, $\Delta_1$ is a first incremental energy value, $\Delta_2$ is a second incremental energy value, and $E_{voice}$.is an energy value indicative of voice energy; and generate a comfort noise signal based on the one or more background noise characteristics.

2. An apparatus for comfort noise generation in a speech communication system, comprising a decoder configured to receive a plurality of information frames indicative of speech plus background noise; estimate one or more background noise characteristics based on the plurality of information frames wherein $$E_{bgn}(m, i) = \begin{cases} E_{ch}(m, i); & E_{ch}(m, i) < E_{bgn}(m-1, i) \\ E_{bgn}(m-1, i) + \Delta; & \text{otherwise} \end{cases} \quad (6)$$

and wherein $E_{bgn}$(m,i) is an estimated background noise energy value of an $i^{th}$ frequency channel of an $m^{th}$ frame of the plurality of information frames, $E_{ch}$(m,i) is a estimated channel energy value of the $i^{th}$ frequency channel of the $m^{th}$ frame of the plurality of information frames, $E_{bgn}$(m−1,i) is an estimated background noise energy value of the $i^{th}$ frequency channel of the $(m-1)^{th}$ frame of the plurality of frequency frames, and Δis an incremental energy value; and generate a comfort noise signal based on the one or more background noise characteristics.

3. The apparatus according to claim 2 further comprising:

a radio frequency receiver to receive a radio signal that includes the information frame and a speaker to present the comfort noise.

4. A method for comfort noise generation in a speech communication system, comprising:

receiving a plurality of information frames indicative of speech plus background noise;

estimating one or more background noise characteristics based on the plurality of information frames wherein $$E_{bgn}(m, i) = \begin{cases} E_{ch}(m, i); & E_{ch}(m, i) < E_{bgn}(m-1, i) \\ E_{bgn}(m-1, i) + \Delta; & \text{otherwise} \end{cases}$$

$E_{bgn}$(m,i) is an estimated background noise energy value of an $i^{th}$ frequency channel of an $m^{th}$ frame of the plurality of information frames, $E_{ch}(m,i)$ is a estimated channel energy value of the $i^{th}$ frequency channel of the $m^{th}$ frame of the plurality of information frames, $E_{bgn}(m-1,i)$ is an estimated background noise energy value of the $i^{th}$ frequency channel of the $(m-1)^{th}$ frame of the plurality of frequency frames, and $\Delta$ is an incremental energy value; and generating a comfort noise signal based on the one or more background noise characteristics.

5. The method according to claim 4, wherein $\Delta$ is at most 0.5 dB.

6. The method according to claim 4, further comprising:

generating a speech signal from the plurality of information frames; and generating an output signal by switching between the comfort noise signal and the speech signal based on a voice activity detection.

7. The method according to claim 6, wherein the voice activity detection is based on non-receipt of information frames containing active voice for a predetermined time.

8. The method according to claim 6, wherein the switching between the comfort noise and the speech signal is performed using an overlap function.

9. The method according to claim 1, wherein generating the comfort noise signal comprises performing an inverse discrete Fourier transform of spectral components derived from the background noise characteristics.

10. The method according to claim 9, wherein the spectral components are derived to have random phases.

11. A method for comfort noise generation in a speech communication system, comprising:

receiving in a packet decoder a plurality of information frames indicative of speech plus background noise;

estimating by a background noise estimator one or more background noise characteristics based on the plurality of information frames wherein $$E_{bgn}(m,i)=\begin{cases}E_{ch}(m,i); & E_{ch}(m,i)<E_{bgn}(m-1,i)\\ E_{bgn}(m-1,i)+\Delta_1; & (E_{ch}(m,i)-E_{bgn}(m-1,i))>E_{voice}\\ E_{bgn}(m-1,i)+\Delta_2; & \text{otherwise}\end{cases}$$

and wherein:

$E_{bgn}(m,i)$ is an estimated background noise energy value of an $i^{th}$ frequency channel of an $m^{th}$ frame of the plurality of information frames, $E_{ch}(m,i)$ is a estimated channel energy value of the $i^{th}$ frequency channel of the $m^{th}$ frame of the plurality of information frames, $E_{bgn}(m-1,i)$ is an estimated background noise energy value of the $i^{th}$ frequency channel of the $(m-1)^{th}$ frame of the plurality of frequency frames, $\Delta_1$ is a first incremental energy value, $\Delta_2$ is a second incremental energy value, and $E_{voice}$, is an energy value indicative of voice energy; and generating a comfort noise signal based on the one or more background noise characteristics.

12. The method according to claim 11, wherein:

$\Delta_1$ is at most 0.5 dB;

$\Delta_2$ is at most 1.0 dB; and $E_{voice}$, is less than 50 dB.

* * * * *